US006806655B2

(12) United States Patent
Choi

(10) Patent No.: US 6,806,655 B2
(45) Date of Patent: Oct. 19, 2004

(54) APPARATUS AND METHOD FOR DRIVING PLASMA DISPLAY PANEL

(75) Inventor: Hak-Ki Choi, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/459,401

(22) Filed: Jun. 10, 2003

(65) Prior Publication Data

US 2004/0032216 A1 Feb. 19, 2004

(30) Foreign Application Priority Data

Jun. 12, 2002 (KR) ..... 10-2002-0032907

(51) Int. Cl.[7] ..... G09G 3/28

(52) U.S. Cl. ..... 315/169.3; 315/169.4; 345/60; 345/68

(58) Field of Search ..... 315/169.3, 169.4, 315/169.1; 345/60, 68, 70, 69, 67, 55

(56) References Cited

U.S. PATENT DOCUMENTS 4,866,349 A * 9/1989 Weber et al. ..... 315/169.4
5,081,400 A * 1/1992 Weber et al. ..... 315/169.4
5,670,974 A * 9/1997 Ohba et al. ..... 345/60
6,680,581 B2 * 1/2004 Lee et al. ..... 315/169.3
6,707,258 B2 * 3/2004 Lee ..... 315/169.3

* cited by examiner

*Primary Examiner*—Don Wong
*Assistant Examiner*—Ephrem Alemu
(74) *Attorney, Agent, or Firm*—Christie, Parker and Hale, LLP

(57) ABSTRACT

In a PDP driver, a sustain part includes first and second switches serially coupled between first and second voltages, and third and fourth switches serially coupled between the first and second voltages. A coupling node of the first and second switches is coupled to one end of the panel capacitor, and a coupling node of the third and fourth switches is coupled to the other end thereof. A charging/discharging part includes an inductor, one end of which is coupled to the coupling node of the first and second switches and the coupling node of the third and fourth switches through first and second paths, and an external capacitor coupled between the other end of the inductor and the second voltage through third and fourth paths.

12 Claims, 4 Drawing Sheets

APPARATUS AND METHOD FOR DRIVING PLASMA DISPLAY PANEL

CROSS REFERENCE TO RELATED APPLICATION

This application claims priority to and the benefit of Korea Patent Application No. 2002-32907 filed on Jun. 12, 2002 in the Korean Intellectual Property Office, the content of which is incorporated herein by reference.

BACKGROUND OF THE INVENTION

1. Field of the Invention

The present invention relates to an apparatus and a method for driving a plasma display panel.

2. Background of the Related Art

A plasma display panel is a kind of display device that selectively excites a plurality of discharge tubes arranged in a matrix form to reproduce video data inputted in the form of an electric signal. Methods of driving the plasma display panel are divided into DC and AC driving modes, according to whether the polarity of voltage applied to maintain discharge is varied with time or not.

In a plasma display panel of a three-electrode lateral discharge structure, address electrodes are arranged intersecting two parallel display electrodes, a scan electrode and a common electrode, in a discharge space formed by barriers. In this structure, discharging for generating wall charges occurs between the address electrodes and the scan electrode in order to select a pixel, and then discharging for displaying an image is repeated for a predetermined period of time between the scan electrode and the common electrode. The barriers not only form the discharge space but also shield light generated when discharge occurs to prevent crosstalk between neighboring pixels. A plurality of unit structures obtained as above is formed on a substrate in a matrix form, and a fluorescent material is coated on each unit structure to construct one pixel. A plurality of pixels formed in this manner construct a plasma display panel. A commercially available current plasma display panel is constructed in such a manner that discharging occurs in each pixel and ultraviolet rays generated according to the discharge excite fluorescent material coated on the inner wall of each pixel to produce a desired color.

In the driving of this AC plasma display panel that is a capacitive load, charging/discharging operations are carried out for all sustain pulses. During the charging/discharging operations, the common electrode and the scan electrode on the upper substrate of the display panel generate a lateral discharge. Before discharging, displacement current must be supplied to the panel that is a capacitive load because sustain occurs only after the displacement current is applied to the panel to charge the panel. In the case of a 42" panel among commercially available products, approximately 2000 sustain pulses are applied over 16.67 ms. Even if a discharge current does not flow whenever all of these sustain pulses are applied, the displacement current must be supplied to the panel. The quantity of displacement current depends on an intrinsic capacitance that varies according to the shape or the material of each pixel, and consumption of ineffective power caused by this capacitance is considerable.

To solve this problem, a variety of methods for reducing the ineffective power have been studied. FIG. 1 shows a power recovery circuit for reducing the ineffective power.

In FIG. 1, switches Y1, Y2, Y3, and Y4, external capacitor C1, inductor L1, and diodes D1 and D2 construct a scan electrode driver, and switches X1, X2, X3, and X4, external capacitor C2, inductor L2, and diodes D3 and D4 construct a common electrode driver. In this configuration, serial resonance occurs between external capacitor C2 and inductor L2 during ON time of switch X1 so that the potential of a common electrode X increases to sustain voltage Vs when the resonance is completed. At this time, switch X2 is turned on to perform sustain. At the falling edge of a sustain pulse, switch X3 is turned on to create serial resonance between a panel capacitor Cp and inductor L2 to recharge external capacitor C2. When the resonance is completed, the potential of the common electrode X becomes identical to the ground voltage. At this time, switch X4 is turned on to maintain the ground voltage.

The aforementioned timing describes an ideal case, and actual timing takes into consideration of delay of drive ICs of FETs. The power recovery operation is executed for all sustain pulses of X and Y electrodes to minimize power consumption of the panel. This conventional power recovery circuit uses an independent circuit for each of the X and Y electrodes to increase the number of capacitors and inductors which results in inefficient operation of each circuit.

SUMMARY OF THE INVENTION

In accordance with the present invention consumption of ineffective power used in a plasma display panel is reduced. Circuits respectively used for a scan electrode and a common electrode are integrated into one circuit to simplify a process of fabricating a plasma display panel driver, reduce the number of capacitors and inductors, and effectively recover power.

In an aspect of the present invention, there is provided an apparatus for driving a plasma display panel including a plurality of scan electrodes and common electrodes arranged in pairs and a panel capacitor formed between each scan electrode and common electrode. The apparatus has a sustain part including first and second switches that are coupled in series between a first voltage and a second voltage, and third and fourth switches that are coupled in series between the first voltage and the second voltage. A coupling node of the first and second switches is coupled to one end of the panel capacitor. A coupling node of the third and fourth switches is coupled to the other end of the panel capacitor. The sustain part maintains the voltage of one end of the panel capacitor and the voltage of the other end of the panel capacitor at the first or second voltage. A charging/discharging part includes an inductor with one end coupled to the coupling node of the first and second switches and the coupling node of the third and fourth switches through first and second paths, respectively, and an external capacitor coupled between the other end of the inductor and the second voltage through third and fourth paths, the charging/discharging part charging the voltage of one end of the panel capacitor and voltage of the other end thereof with the first voltage or discharging them to the second voltage.

The apparatus for driving a plasma display panel of the invention can further include fifth and sixth switches that are coupled between the panel capacitor and the inductor through the first and second paths, respectively, to select a path of current flowing through the panel capacitor from the first and second paths.

The apparatus for driving a plasma display panel of the invention can further include a seventh switch and a first diode that are placed on the third path to set a path of current supplied to the panel capacitor, and an eighth switch and a second diode that are located on the fourth path to set a path of current recovered from the panel capacitor.

In another aspect of the present invention, there is also provided a method for driving a plasma display panel having a panel capacitor with both ends supplied with first and second voltages alternately, an external capacitor supplied with a voltage corresponding to the middle level between the first and second voltages, and an inductor coupled to the external capacitor. The voltage of one end of the panel capacitor is charged up to the first voltage using resonance that is generated when the inductor is coupled to one end of the panel capacitor through a first path. The voltage of one end of the panel capacitor is discharged to the second voltage using resonance that occurs when the inductor is coupled to one end of the panel capacitor through the first path. The voltage of the other end of the panel capacitor is charged up to the first voltage using resonance that is generated when the inductor is coupled to the other end of the panel capacitor through a second path. The voltage of the other end of the panel capacitor is discharged to the second voltage using resonance generated when the inductor is coupled to the other end of the panel capacitor through the second path.

The charging of the voltage of one end of the panel capacitor can include maintaining the voltage of one end of the panel capacitor at the first voltage using first and second switches, which are coupled in series between the first voltage and the second voltage, and third and fourth switches, which are coupled in series between the first voltage and the second voltage. A coupling node of the first and second switches is coupled to one end of the panel capacitor. A coupling node of the third and fourth switches is coupled to the other end of the panel capacitor. The charging of the voltage of the other end of the panel capacitor can include maintaining the voltage of the other end of the panel capacitor at the first voltage using the first, second, third, and fourth switches.

The method for driving a plasma display panel according to the present invention can select a path of current flowing through the panel capacitor from the first and second paths using fifth and sixth switches that are respectively coupled to the first and second paths.

Each of the switches used in the apparatus and method for driving a plasma display panel of the invention can have a body diode.

In another aspect of the present invention, there is also provided an apparatus for driving a plasma display panel including a first electrode and a second electrode, and a panel capacitor formed between the first electrode and the second electrode. The apparatus includes a power source supplying a first voltage, an inductor, a first current path formed from the power source to the first electrode via the inductor to generate a resonance between the panel capacitor and the inductor, thereby changing the voltage of the first electrode to a second voltage, while the voltage of the second electrode is maintained to a third voltage. A second current path is formed from the first electrode to the power source via the inductor to generate a resonance between the panel capacitor and the inductor, thereby changing the voltage of the first electrode to the third voltage, while the voltage of the second electrode is maintained to the third voltage. A third current path is formed from the power source to the second electrode via the inductor to generate a resonance between the panel capacitor and the inductor, thereby changing the voltage of the second electrode to the second voltage, while the voltage of the first electrode is maintained to the third voltage. A fourth current path is formed from the second electrode to the power source via the inductor to generate a resonance between the panel capacitor and the inductor, thereby changing the voltage of the second electrode to the third voltage, while the voltage of the first electrode is maintained to the third voltage.

DETAILED DESCRIPTION

Figure 1:
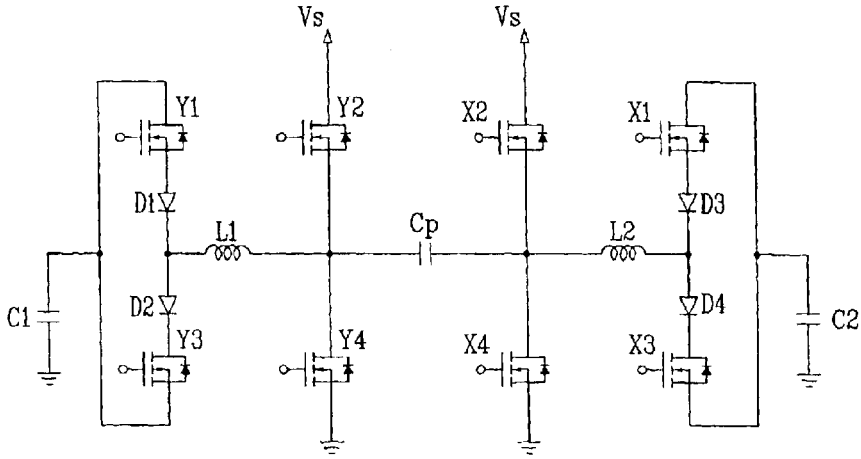
FIG.1(PRIOR ART)
FIG. 1 shows a power recovery circuit of a conventional plasma display panel.
Figure 2:
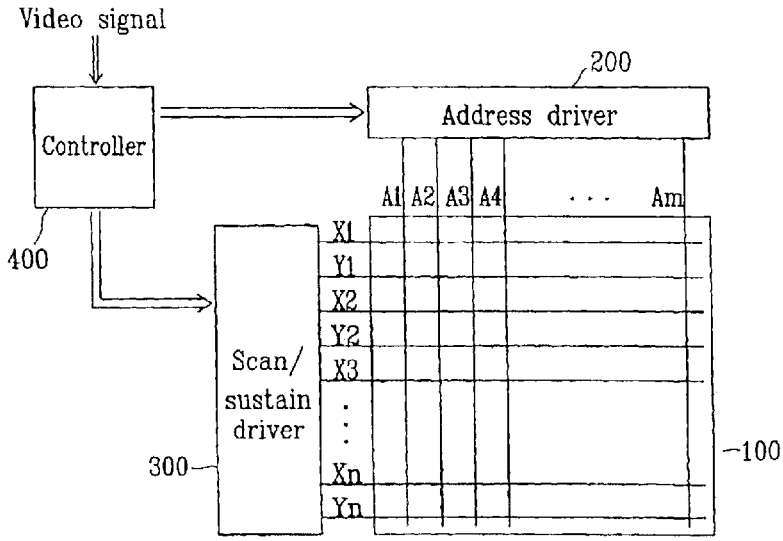
FIG. 2 shows a plasma display panel according to an embodiment of the present invention.

FIG. 2 shows a plasma display panel according to an embodiment of the present invention. Referring to FIG. 2, the plasma display panel of the invention includes plasma panel 100, address driver 200, scan/sustain driver 300, and controller 400.

Plasma panel 100 includes a plurality of address electrodes A1 to Am arranged in a row direction, and a plurality of scan electrodes Y1 to Yn and sustain electrodes X1 to Xn alternately arranged in a column direction.

Address driver 200 receives an address driving control signal from controller 400 to apply address voltage Va for selecting a discharge cell to be displayed to each address electrode.

Scan/sustain driver 300 accepts a sustain signal from controller 400 to apply a sustain voltage to the scan electrode and sustain electrodes alternately, creating sustain for the selected discharge cell. Scan/sustain driver 300 includes a power recovery circuit (shown in FIG. 3) that is a circuit for recovering ineffective power to use.

Controller 400 receives a video signal from the outside to generate the address driving control signal and the sustain signal, and respectively supplies them to address driver 200 and scan/sustain driver 300.

A power recovery circuit and a method of driving the same according to a first embodiment of the present invention are explained with reference to FIGS. 3 and 4.

Figure 3:
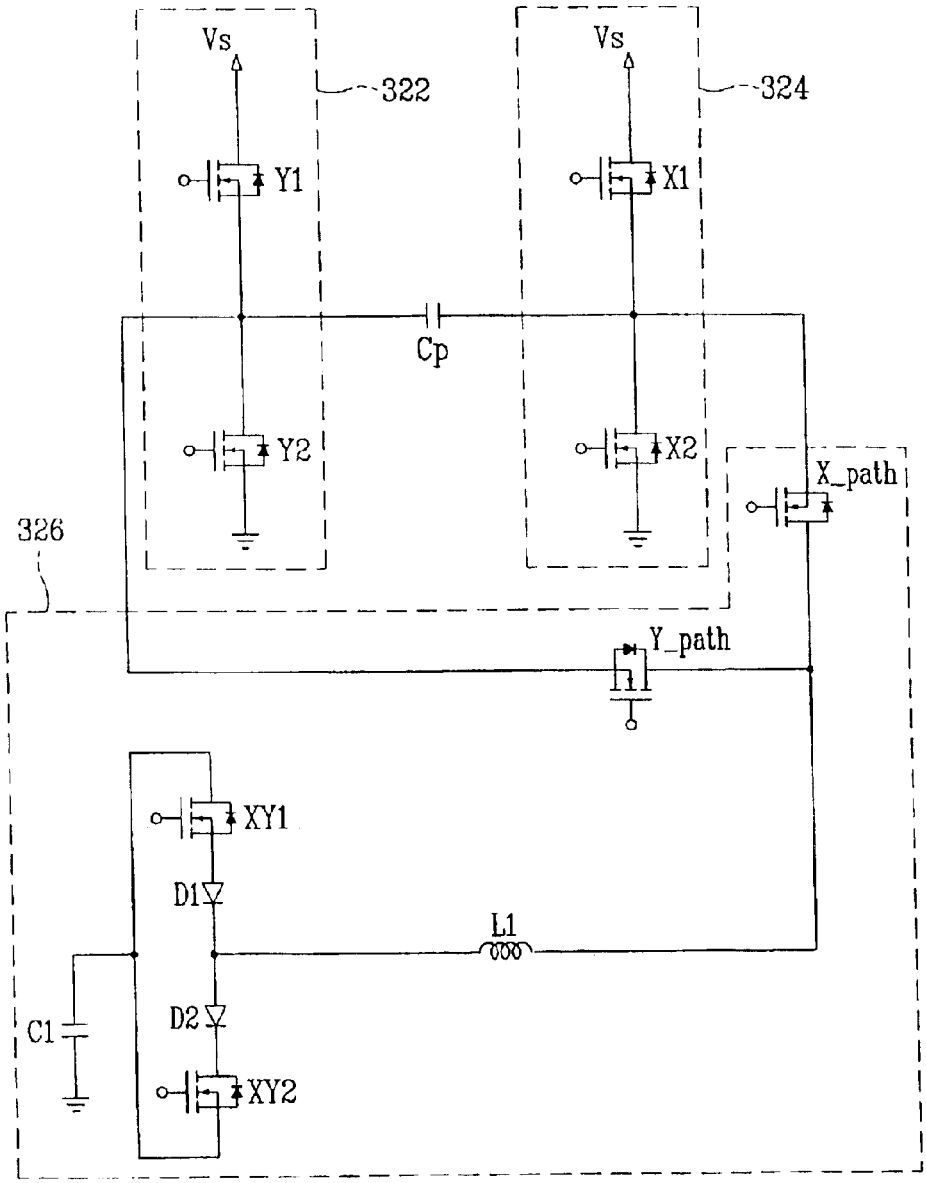
FIG. 3 shows a circuit for driving the plasma display panel according to an embodiment of the present invention.
Figure 4:
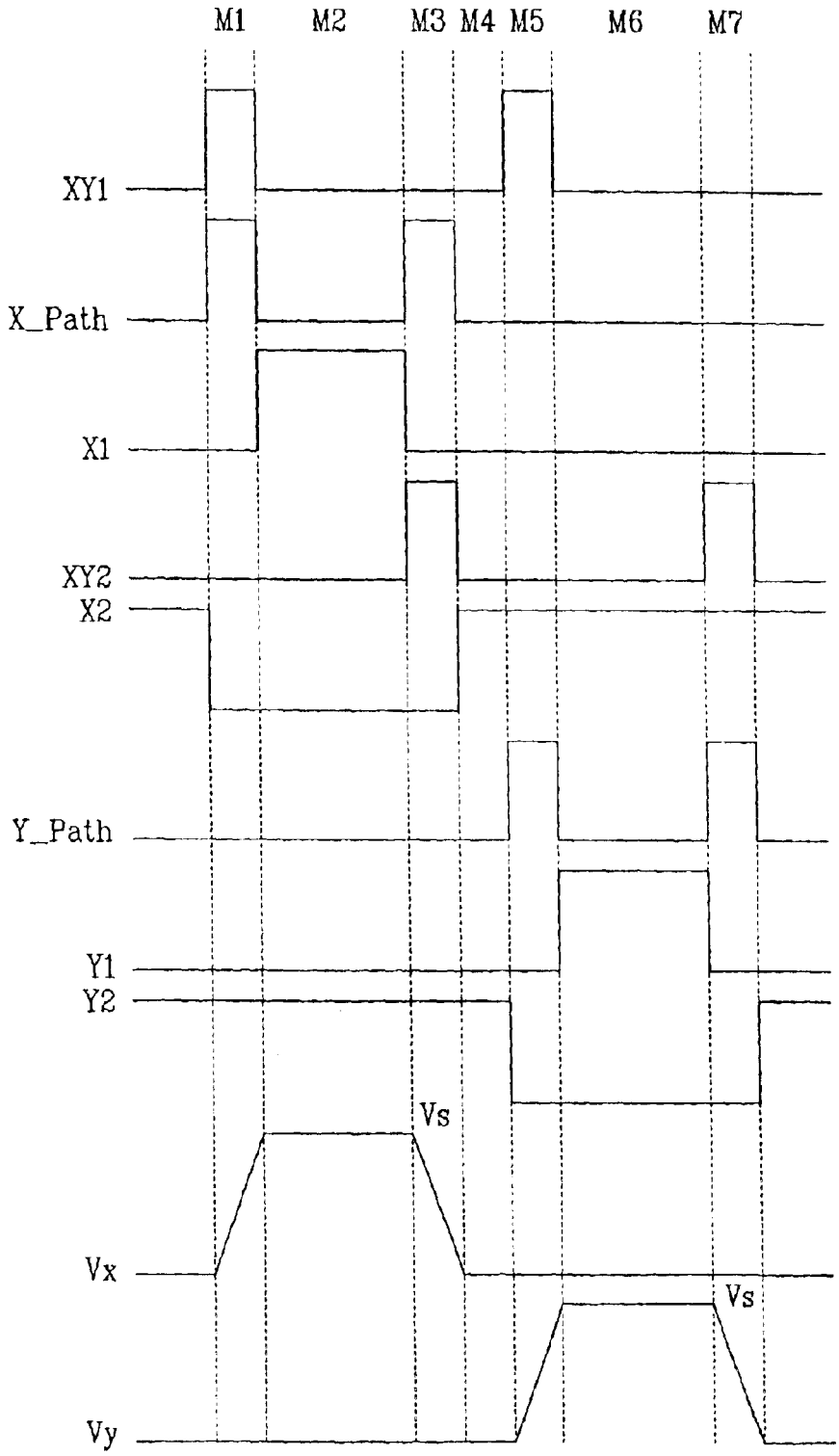
FIGS. 4 and 5 show operation timing according to the first and second embodiments of the present invention.

FIG. 3 shows the power recovery circuit according to the first embodiment of the invention, and FIG. 4 shows the operational timing of the power recovery circuit according to the first embodiment of the invention.

As shown in FIG. 3, the power recovery circuit according to the first embodiment of the invention includes Y-electrode sustain part 322, X-electrode sustain part 324, and charging/discharging part 326.

Y-electrode sustain part 322 has switches Y1 and Y2 which are coupled in series between a power supply providing sustain voltage Vs and ground. A coupling node of switches Y1 and Y2 is coupled to a Y electrode of panel capacitor Cp.

X-electrode sustain part 324 includes switches X1 and X2 which are coupled in series between the power supply providing sustain voltage Vs and ground. A coupling node of the two switches is coupled to an X electrode of panel capacitor Cp.

Charging/discharging part 326 has inductor L1 and external capacitor C1. External capacitor C1 functions as a power source for supplying a half of the voltage between sustain voltage Vs supplied by the power supply and ground voltage 0V. Accordingly, when the switches Y1 and X1 are coupled to a power source for supplying Vs/2 volts, and switches Y2 and X2 are coupled to a power source for supplying −Vs/2 volts, external capacitor C1 does not needed to be provided thereto. Switches X_path and Y_path are respectively coupled to both sides of panel capacitor Cp. Inductor L1 is coupled to the coupling node of the two switches X_path and Y_path, and external capacitor C1 is coupled to inductor L1. Switch XY1 and diode D1 are coupled in series between external capacitor C1 and inductor L1. Switch XY2 and diode D2 are also coupled in series between external capacitor C1 and inductor L1. The other side of the external capacitor is coupled to ground.

A time-series variation in the operation of the power recovery circuit according to the first embodiment of the present invention is explained below with reference to FIG. 4. Here, the variation passes through seven modes M1 to M7, and all variations occur according to operations of the switches. The phenomenon, which is referred to as LC resonance below, is not a continuous oscillation but rather transient variations of voltage and current according to combination of the inductor and the panel capacitor, generated when the switches are turned on.

In the first embodiment of the present invention, let it be assumed that external capacitor C1 is charged with voltage Vs/2 corresponding to half of sustain voltage Vs, and switches X2 and Y2 are turned on so that X and Y electrode voltages Vx and Vy of panel capacitor Cp maintain the ground voltage.

In first mode M1, switches XY1 and X_path are turned on and switch X2 is turned off when switch Y2 has already been turned on. Then, LC resonance is generated on a path that is set from external capacitor C1, switch XY1, inductor L1, and switch X_path to panel capacitor Cp. According to this LC resonance, X electrode voltage Vx increases to sustain voltage Vs. X electrode voltage Vs does not exceed sustain voltage Vs because of the body diode of switch X1. In this state, Y electrode voltage Vy maintains the ground voltage because switch Y2 has been turned on.

In second mode M2, when X electrode voltage Vx reaches sustain voltage Vs, switches XY1 and X_path are turned off and switch X1 is turned on so that X electrode voltage Vx sustains sustain voltage Vs. The Y electrode voltage maintains the ground voltage because switch Y2 continues its turned-on state.

In third mode M3, switch X1 is turned off and switches XY2 and X_path are turned on. Then, LC resonance occurs on a path that is set from panel capacitor Cp, switch X_path, inductor L1, and switch XY2 to external capacitor C1. According to this LC resonance, X electrode voltage Vx decreases to the ground voltage. Here, X electrode voltage Vx does not decrease lower than the ground voltage because of the body diode of switch X2. Switch Y2 continues its turn-on state so that Y electrode voltage Vy sustains the ground voltage.

In fourth mode M4, when X electrode voltage Vx reaches the ground voltage, switches XY2 and X_path are turned off and switch X2 is turned on so that X electrode voltage Vx sustains the ground voltage. Y electrode voltage Vy maintains the ground voltage because switch Y2 is on continuously.

In fifth mode M5, switches XY1 and Y_path are turned on and switch Y2 is turned off. Then, LC resonance generates on a path that is set from external capacitor C1, switch XY1, inductor L1, and switch Y_path to panel capacitor Cp. According to this LC resonance, Y electrode voltage Vy increases to sustain voltage Vs. At this time, Y electrode voltage Vy does not exceed the sustain voltage because of the body diode of switch Y1. In this state, switch X2 is in the conductive state so that X electrode voltage Vx maintains the ground voltage.

In sixth mode M6, when Y electrode voltage Vy reaches sustain voltage Vs, switches XY1 and Y_path are turned off and switch Y1 is turned on so that Y electrode voltage Vy maintains sustain voltage Vs. X electrode voltage Vx sustains the ground voltage because switch X2 continues its conductive state.

In seventh mode M7, switch Y1 is turned off and switches XY2 and Y_path are turned on. Then, Y electrode voltage Vy decreases to the ground voltage according to resonance that generates on a path that is set from panel capacitor Cp, switch Y_path, inductor L1, and switch XY2, to external capacitor C1. Here, Y electrode voltage Vy does not decrease lower than the ground voltage because of the body diode of switch Y2. Switch X2 continues its conductive state so that X electrode voltage Vx sustains the ground voltage.

Next, when Y electrode voltage Vy reaches the ground voltage, switches XY2 and Y_path are turned off and switch Y2 is turned on so that Y electrode voltage Vy sustains the ground voltage. X electrode voltage Vx maintains the ground voltage because switch X2 is on continuously.

A method of driving the power recovery circuit according to the second embodiment of the present invention is explained below with reference to FIG. 5.

Figure 5:
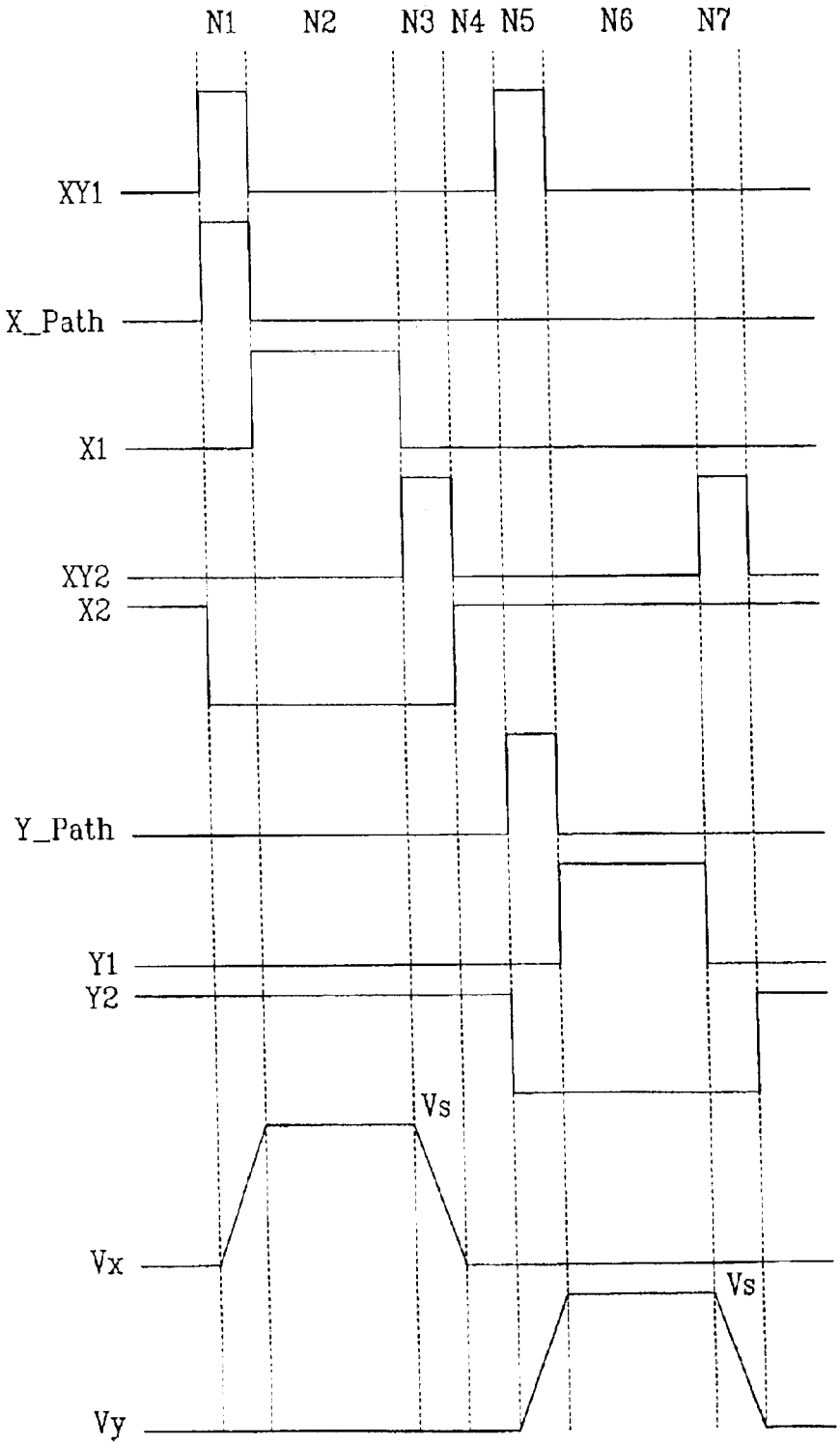

FIG. 5 shows operation timing of the power recovery circuit according to the second embodiment of the invention.

First and second modes N1 and N2 are identical to first and second modes M1 and M2 of the first embodiment. In third mode N3 in which X electrode voltage Vx is decreased to the ground voltage, however, only switch XY2 is turned on. Then, X electrode voltage Vx decreases to the ground voltage according to resonance that generates on a path set from panel capacitor Cp, the body diode of switch X_path, inductor L1, and switch XY2 to external capacitor C1. X electrode voltage Vx does not decrease below the ground voltage because of the body diode of switch X2. Switch Y2 is in the conductive state so that Y electrode voltage Vy sustains the ground voltage.

Consequently, switch X_path is not turned on so that generation of heat, caused by an increase in a switching frequency of switch X_path, can be reduced.

Fourth, fifth, and sixth modes N4, N5, and N6 are identical to fourth, fifth, and sixth modes M4, M5, and M6 of the first embodiment. In seventh mode N7 in which Y electrode voltage Vy decreases to the ground voltage, however, only switch XY2 is turned on. Then, Y electrode voltage Vy decreases to the ground voltage according to resonance that occurs on a path that is set from panel capacitor Cp, the body diode of switch Y_path, inductor L1, and switch XY2 to external capacitor C1. Y electrode voltage Vy does not decrease below the ground voltage because of the body diode of switch Y2. Switch X2 is in the conductive state so that X electrode voltage Vx sustains the ground voltage.

Consequently, generation of heat, caused by an increase in a switching frequency of switch Y_path, can be reduced because switch Y_path is not turned on.

As described above, the present invention integrates the scan electrode driving circuit and the common electrode driving circuit of the plasma display panel into one board. Accordingly, a process of fabricating the plasma display panel can be simplified and the number of capacitors and inductors can be reduced. Furthermore, the switches can be designed such that their withstand voltages are reduced by properly utilizing the common electrode path switch X_path and scan electrode path switch Y_path, which are located on the power recovery paths, as is seen in FIG. 3.

The forgoing embodiments are merely exemplary and are not to be construed as limiting the present invention. Various alternatives, modifications, and variations will be apparent to those skilled in the art.

What is claimed is:

1. An apparatus for driving a plasma display panel having a plurality of scan electrodes and common electrodes arranged in pairs, and a panel capacitor formed between each scan electrode and common electrode, the apparatus comprising:

a sustain part including a first swich and a second switch that are each coupled in series between a first voltage and a second voltage, and a third switch and a fourth switch that are each coupled in series between the first voltage and the second voltage, a coupling node of the first switch and a coupling node of the second switch being each coupled to one end of the panel capacitor, a coupling node of the third switch and a coupling node of the fourth switch being each coupled to the other end of the panel capacitor, the sustain part maintaining a voltage of the one end of the panel capacitor and a voltage of the other end of the panel capacitor at the first voltage or the second voltage; and a charging/discharging part including an inductor with one inductor end coupled to the coupling node of the first switch and the coupling node of the second switch through a first path and to the coupling node of the third switch and the coupling node of the fourth switch through a second path, and an external capacitor coupled between the other end of the inductor and the second voltage through a third path and a fourth path, the charging/discharging part charging the voltage of one end of the panel capacitor and the voltage of the other end thereof with the first voltage or discharging the voltage of the one end of the panel capacitor and the voltage of the other end of the panel capacitor to the second voltage.

2. The apparatus for driving a plasma display panel of claim 1, further comprising a fifth switch and a sixth switch that are each coupled between the panel capacitor and the inductor through the first path and the second path, respectively, to select a path of current flowing through the panel capacitor from the first path and the second path.

3. The apparatus for driving a plasma display panel of claim 2, wherein each of the first switch, second switch, third switch, fourth switch, fifth switch and sixth switch has a body diode.

4. The apparatus for driving a plasma display panel of claim 1, further comprising a fifth switch and a first diode that are located on the third path to set a path of current supplied to the panel capacitor, and a sixth switch and a second diode that are located on the fourth path to set a path of current recovered from the panel capacitor.

5. A method for driving a plasma display panel having a panel capacitor with both ends supplied with a first voltage and a second voltage alternately, and having an external capacitor supplied with a voltage corresponding to a middle level between the first voltage and the second voltage, and an inductor coupled to the external capacitor, the method comprising:

(a) charging a voltage of one end of the panel capacitor up to the first voltage using resonance that is generated when the inductor is coupled to one end of the panel capacitor through a first path;

(b) discharging a voltage of one end of the panel capacitor to the second voltage using resonance that occurs when the inductor is coupled to one end of the panel capacitor through the first path;

(c) charging a voltage of the other end of the panel capacitor up to the first voltage using resonance that is generated when the inductor is coupled to the other end of the panel capacitor through a second path; and (d) discharging the voltage of the other end of the panel capacitor to the second voltage using resonance generated when the inductor is coupled to the other end of the panel capacitor through the second path.

6. The method for driving a plasma display panel of claim 5, wherein charging a voltage of one end of the panel capacitor up to the first voltage further comprises maintaining the voltage of one end of the panel capacitor at the first voltage using a first switch and a second switch that are each coupled in series between the first voltage and the second voltage, and a third switch and a fourth switch that are each coupled in series between the first voltage and the second voltage, with a coupling node of the first swtich and a coupling node of the second switch being each coupled to one end of the panel capacitor and a coupling node of the third switch and a coupling node of the fourth switch each being coupled to the other end of the panel capacitor, and wherein charging a voltage of the other end of the panel capacitor up to the first voltage further comprises maintaining the voltage of the other end of the panel capacitor at the first voltage using the first switch, the second switch, the third switch and the fourth switch.

7. The method for driving a plasma display panel of claim 6, wherein each of the first switch, second switch, third switch and fourth switch has a body diode.

8. The method for driving a plasma display panel of claim 5, wherein a path of current flowing through the panel capacitor is selected from the first path and the second path using a first switch and a second switch that are respectively coupled to the first path and the second path.

9. The method for driving a plasma display panel of claim 8, wherein each of the first switch and the second switch has a body diode.

10. An apparatus for driving a plasma display panel including a first electrode and a second electrode, and a panel capacitor formed between the first electrode and the second electrode, the apparatus comprising:

a power source supplying a first voltage;

an inductor;

a first current path formed from the power source to the first electrode via the inductor to generate a resonance between the panel capacitor and the inductor, thereby changing the voltage of the first electrode to a second voltage, while the voltage of the second electrode is maintained to a third voltage;

a second current path formed from the first electrode to the power source via the inductor to generate a resonance between the panel capacitor and the inductor, thereby changing the voltage of the first electrode to the third voltage, while the voltage of the second electrode is maintained to the third voltage;

a third current path formed from the power source to the second electrode via the inductor to generate a resonance between the panel capacitor and the inductor, thereby changing the voltage of the second electrode to the second voltage, while the voltage of the first electrode is maintained to the third voltage; and a fourth current path formed from the second electrode to the power source via the inductor to generate a resonance between the panel capacitor and the inductor, thereby changing the voltage of the second electrode to the third voltage, while the voltage of the first electrode is maintained to the third voltage.

11. The apparatus for driving a plasma display panel of claim 10, wherein the first electrode is coupled to a first power source supplying the second voltage after the voltage of the first electrode is changed to the second voltage, and is coupled to a second power source supplying the third voltage after the voltage of the first electrode is change to the third voltage.

12. The apparatus for driving a plasma display panel of claim 10, wherein the second electrode is coupled to the first power source after the voltage of the second electrode is changed to the second voltage, and is coupled to the second power source after the voltage of the second electrode is change to the third voltage.

* * * * *